US005697429A

United States Patent [19]

Laveran et al.

[11] Patent Number: 5,697,429

[45] Date of Patent: Dec. 16, 1997

[54] HEAT EXCHANGER HAVING A HEADER IN THE FORM OF A STACK

[75] Inventors: Jean-Louis Laveran, Asnieres sur Seine; Jean-François Chevalier, Andresy, both of France

[73] Assignee: Valeo Thermique Moteur, La Verriere, France

[21] Appl. No.: 685,398

[22] Filed: Jul. 23, 1996

[30] Foreign Application Priority Data

Jul. 25, 1995 [FR] France ..... 95 09024

[51] Int. Cl.[6] ..... F28D 1/053; F28F 13/12

[52] U.S. Cl. ..... 165/109.1; 165/152; 165/153

[58] Field of Search ..... 165/109.1, 152, 165/153, 173

[56] References Cited

U.S. PATENT DOCUMENTS 2,360,123 10/1944 Gerstung et al. ..... 165/109.1 X
4,815,532 3/1989 Sasaki et al. ..... 165/152

FOREIGN PATENT DOCUMENTS 0 646 759 4/1995 European Pat. Off. .
2 563 899 11/1985 France .
2 657 423 7/1991 France .

*Primary Examiner*—Allen J. Flanigan
*Attorney, Agent, or Firm*—Morgan & Finnegan LLP

[57] ABSTRACT

A heat exchanger has a header in the form of a stack consisting of pairs of shells, with the two shells of each pair being assembled together through their outer flanges, and with two adjacent shells, each belonging to a different pair, being joined together through annular inner flanges which are joined to the outer flanges of the shells through annular side walls. The outer flanges of the two shells of each pair, which define a housing for the end of an associated flattened fluid flow tube, also bear on the faces of a turbulator plate which projects out of the corresponding tube. The contact of the shells with the turbulator plate improves the rigidity of the header. The invention is applicable to the cooling of supercharging air in industrial vehicle engines.

7 Claims, 1 Drawing Sheet

HEAT EXCHANGER HAVING A HEADER IN THE FORM OF A STACK

FIELD OF THE INVENTION

This invention relates to a heat exchanger of the kind comprising a row of tubes for flow of fluid therein, with each tube containing a turbulator plate which is adapted to produce turbulent flow of the fluid in the tube, together with at least one header which extends lengthwise in the direction in which the tubes are aligned, with an end of each tube being open into the header, the said header comprising a stack of pairs of shells, in which each shell has an annular side wall which is joined firstly to an annular outer flange of the shell, and secondly to an annular inner flange of the shell which is defined by the base portion of the latter, the base portion having an axial through aperture therein, the two said flanges lying substantially in radial planes, and the shells of each pair being abutted on each other and assembled together through their outer flanges, while two adjacent shells, each of which belongs to a different one of the said pairs, are abutted together and joined together through their inner flanges, the pairs of shells together defining an internal chamber over the whole length of the stack constituting the header, with the walls of the two shells of each pair being so configured as to define a lateral aperture into which the end of a corresponding said tube is inserted so as to communicate with the header chamber.

BACKGROUND OF THE INVENTION

Such a heat exchanger is known from French patent specification No. FR 2 563 899 A. In this known heat exchanger, the shells constituting the header are in contact only with each other and with the ends of the tubes which are engaged in the lateral apertures. This arrangement has been found to give insufficient rigidity to the header thus constructed.

DISCUSSION OF THE INVENTION

An object of the invention is to overcome the above mentioned drawback. In particular, the invention provides a heat exchanger of the kind defined above under "Field of the Invention".

According to the invention, in such a heat exchanger the turbulator plate projects beyond the end of the tube, so as to make contact with the shells of the corresponding pair of shells over at least a fraction of the periphery of the internal chamber of the header.

The projecting portion of the turbulator plate offers supplementary contact zones for the shells, thus improving the structural stability of the latter, and consequently the rigidity of the header for a given thickness of the shells.

The heat exchanger in accordance with the invention may be used in particular for cooling supercharging air for a heat engine for propulsion of a vehicle. More particularly, it is applicable to an industrial vehicle. Two headers may of course be provided in the heat exchanger, with the two ends of each tube penetrating respectively into the two headers, and the turbulator plate projecting under the same conditions into the two headers at the two ends of the tubes.

According to a preferred feature of the invention, the outer flange of at least one of the shells in each pair has an annular region adjacent to the lateral wall thereof, which is offset towards the plane of the inner flange of the shell and which cooperates with the outer flange of the other shell to define between them a housing for receiving the turbulator plate.

According to another preferred feature of the invention, the two shells of each pair are identical with each other, with one respective half of the thickness of the said housing being defined by the said offset region of each outer flange.

Preferably, the said annular region is joined, on the same side of the header as the associated tube, to a marginal region of the same outer flange which is offset even more, the offset marginal regions of the two shells of the pair together defining a housing for the end of the tube.

The region of the turbulator plate which projects with respect to the tube preferably has an aperture which is aligned with the axial apertures of the shells, so as not to hinder the circulation of the fluid in the said header chamber.

According to a further preferred feature of the invention, the outer flange of each shell is joined, over at least part of its periphery, to a skirt portion which extends axially towards the plane of the inner flange of the same shell.

The outer flange and the side wall of each shell preferably have, respectively, a substantially rectangular contour and a circular cross section.

The various features and advantages of the invention will appear more clearly on a reading of the detailed description of a preferred embodiment of the invention which is given below, by way of example only and with reference to the accompanying drawings.

DESCRIPTION OF A PREFERRED EMBODIMENT OF THE INVENTION

Figure 1:
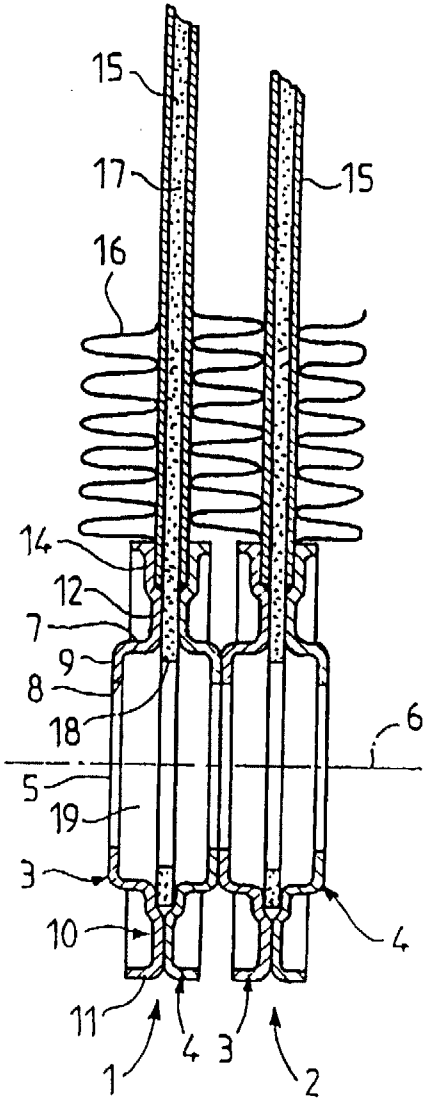

FIG. 1 shows two pairs 1 and 2 of metallic members in the form of dishes or shells, press-formed from sheet metal and forming part of a stack of members constituting a fluid header. The header is not shown complete. Each of these pairs of shells consists of two shells 3 and 4 which are identical to each other.

Each shell has a base portion 5 which lies in a radial plane, that is to say a plane at right angles to the longitudinal axis 6 of the header. The base portion 5 of each shell is joined to an annular side wall 7, each of these side walls defining a body of revolution about the axis 6. The base portion 5 has a central through aperture 8, which again defines a figure of revolution about the axis 6, and which also defines about the axis 6 an annular internal flange 9.

Figure 3:
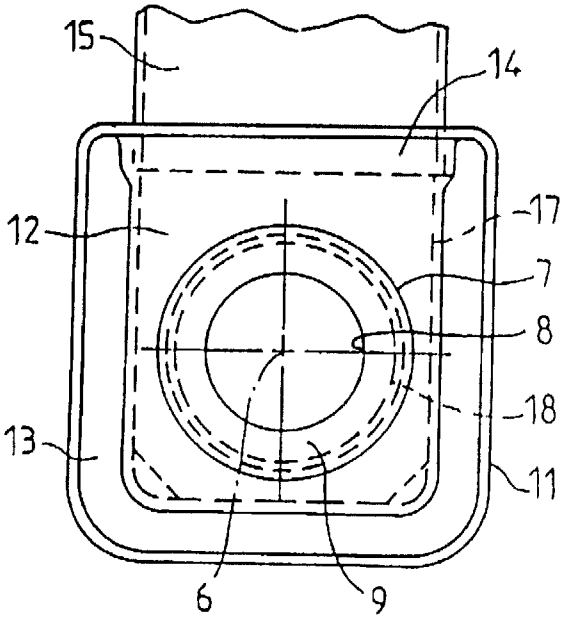
FIG. 3 is a scrap view seen in the axial direction, i.e. along, the header.

Opposite to the base portion 5, considered in the axial direction, the side wall 7 is joined to an annular flange 10 which extends radially outwardly. As is best seen in FIG. 3, the outer flange 10 has a rectangular external profile with rounded corners, and is joined in its turn to a peripheral annular skirt portion 11 which faces axially towards the base portion 5.

The outer flange 10 has three regions which are situated substantially in three radial planes. A first annular region 12, having a rectangular external profile, directly surrounds the side wall 7. This region 12 is bounded on three of its sides by a second region, or portion, 13 in the form of a U-shaped band that extends to the periphery of the flange 10, so as to join the latter to the skirt portion 11 along three sides of the rectangular perimeter of the shell. Finally, a third region or portion 14, in the form of a straight marginal band, extends between the fourth side of the first region 12 and the fourth side of the rectangular perimeter of the shell, over a length which is slightly greater than the corresponding dimension of the region 12. The planes in which the three regions 13, 12 and 14 lie at increasing distances from the plane in which the base portion 5 lies, and these three regions are joined together by portions bent in the axial direction. Thus the region 12 of the outer flange 10 is offset axially towards the plane of the inner flange 9, and the region 14 is similarly offset by an even greater amount.

Figure 2:
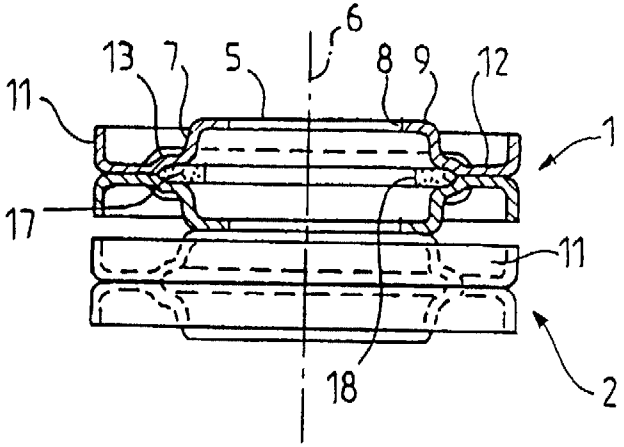
FIGS. 1 and 2 are views in cross section showing part of a heat exchanger in a preferred embodiment of the invention, each of these Figures being in a cross section, with the respective cross sections being taken in planes (indicated in phantom lines in FIG. 3) which are at right angles to each other and which pass through the axis of the header.

As can be seen in FIGS. 1 and 2, the two shells 3 and 4 of a pair 1 or 2 are abutted together through the marginal region 13 of their outer flanges 10, with the annular regions 12, the marginal regions 14 and the inner flanges 9 of the two shells lying, in this order (see FIG. 1), at increasing axial distances from each other. The two regions 14 define together a housing for the end of a flattened tube 15 which is part of a row of tubes, each of which is associated with one of the pairs of shells of the header.

In a manner known per se, the tubes in the row are aligned alternatively with inserts 16 in the form of corrugated metallic strips, with the crests of the corrugations of each strip making alternate contact with two adjacent tubes 15. Again in a manner known per se, the internal space of each tube contains a turbulator plate 17 for setting up turbulence in the flow of the fluid that passes through the tube. The turbulator plate consists for example of a corrugated metallic strip, the crests of the corrugations of which make alternate contact with the two opposed inner faces of the tube. This strip is also perforated to enable the fluid to flow.

Each turbulator plate 17 projects beyond the ends of the corresponding tube 15, between the two shells 3 and 4 to which that tube is fitted. The plate 17 makes contact with the annular regions 12 of the outer flanges 10 of the shells over substantially the whole extent of those regions 12. In its projecting portion, each turbulator plate 17 has a circular through aperture 18 which is aligned with the apertures 8 in the base portions of the shells. The diameter of each aperture 18 is approximately the same as that of the side walls 7 of the shells, so as to allow free communication between the internal spaces 19 delimited by the base portion 5 and the side wall 7 of each shell.

Again as can be seen in FIGS. 1 and 2, the pairs 1 and 2 of shells are abutted and assembled together through the outer surfaces (facing towards each other) of the internal flanges 9 of their respective shells. The peripheral skirt portions 11 of these shells face towards each other, but are spaced slightly apart. The other pairs of shells (not shown) are assembled in the same way so as to form the stack that constitutes the header.

In the header, the internal spaces 19 of the various pairs of shells are in communication with each other through the apertures 8, so as to form an internal header chamber which extends over the whole length of the header, the tubes 15 being in communication with this internal chamber. The latter is separated, and sealed from, the outside of the heat exchanger by virtue of the fact that the abutted internal flanges 9 are brazed together, the abutted marginal regions 13 are brazed together, while the straight regions 14, with the bent portions that join them to the marginal regions 13, are brazed on to the tubes 15.

What is claimed is:

1. A heat exchanger comprising a plurality of tubes for flow of fluid therein, the said tubes being arranged in a row; a turbulator plate disposed within each said tube for producing turbulent flow of said fluid in the tube, the said tubes defining a direction in which the tubes are aligned with each other in said row; and at least one header, which extends lengthwise in the said direction of alignment of the tubes, with each said tube having an end open into the said header, the header comprising a plurality of shells disposed in pairs, the said pairs of shells being stacked together to form the header so as to define a header axis in said alignment direction, each shell comprising an annular side wall extending generally in said alignment direction, an annular outer flange joined to one end of said side wall, an annular inner flange joined to the other end of said side wall, and a base portion defining the said inner flange and further defining an axially extending first aperture, each said outer and inner flange defining a plane substantially radial with respect to the header axis, the shells of each said pair being abutted to each other and assembled together through their outer flanges, with adjacent shells that belong to different pairs being abutted together and assembled together through their said inner flanges, the said shells defining an internal header chamber within their lateral walls, said chamber extending over the whole length of the said stack, and the two shells of each said pair being so configured as to define a lateral second aperture in which the said end of a corresponding said tube is received for communication of the inside of the tube with the said header chamber, wherein each said turbulator plate projects beyond the end of the corresponding said tube so as to make contact with the pair of shells associated with that tube, over at least a fraction of the periphery of the header chamber.

2. A heat exchanger according to claim 1, wherein the said outer flange of at least one of the shells of each pair includes an annular region adjacent to its side wall and offset towards the radial plane of the inner flange, the said offset annular region cooperating with the outer flange of the other shell of the pair so as to define between them a housing receiving the said turbulator plate.

3. A heat exchanger according to claim 2, wherein the two shells of each said pair are identical with each other, with the said offset annular region of each outer flange defining one half of the thickness of the said housing.

4. A heat exchanger according to claim 3, wherein each said shell has a marginal region of the said outer flange thereof, the said marginal region being offset toward the base portion of the shell by an amount greater than the offset of the said annular offset region, the said marginal regions of the two shells of the pair defining a housing between them for receiving the end of the corresponding said tube.

5. A heat exchanger according to claim 1, wherein the portion of each turbulator plate projecting from the associated tube has a third aperture which is aligned with the said first apertures whereby to permit free circulation of fluid in the header chamber.

6. A heat exchanger according to claim 1, wherein each said shell further includes a skirt portion extending axially towards the said radial plane of the inner flange of the shell, the said outer flange of the shell being joined to the said skirt portion over at least part of the periphery of the latter.

7. A heat exchanger according to claim 1, wherein the outer flange of each said shell has a substantially rectangular contour, the side wall of each shell having a circular cross section.

* * * * *